US010218115B1

(12) United States Patent
Yao et al.

(10) Patent No.: US 10,218,115 B1
(45) Date of Patent: Feb. 26, 2019

(54) ADAPTER AND ELECTRONIC DEVICE HAVING THE ADAPTER

(71) Applicant: WISTRON NEWEB CORPORATION, Hsinchu (TW)

(72) Inventors: Yi-Wei Yao, Hsinchu (TW); Kuo-Feng Huang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 15/679,607

(22) Filed: Aug. 17, 2017

(51) Int. Cl.

| | |
|---|---|
| ***H01R 24/00*** | (2011.01) |
| ***H01R 25/00*** | (2006.01) |
| ***H01R 13/627*** | (2006.01) |
| ***H01R 13/24*** | (2006.01) |
| ***H01R 24/58*** | (2011.01) |
| ***H01R 13/62*** | (2006.01) |
| ***H01R 13/516*** | (2006.01) |
| ***H01R 24/28*** | (2011.01) |
| ***H01R 24/86*** | (2011.01) |
| *H01R 107/00* | (2006.01) |

(52) U.S. Cl.
CPC ..... *H01R 13/6278* (2013.01); *H01R 13/2492* (2013.01); *H01R 13/516* (2013.01); *H01R 13/62* (2013.01); *H01R 24/28* (2013.01); *H01R 24/58* (2013.01); *H01R 24/86* (2013.01); *H01R 2107/00* (2013.01); *H01R 2201/06* (2013.01)

(58) Field of Classification Search
CPC ..... H01R 13/62; H01R 13/6278; H01R 13/2492; H01R 24/28; H01R 24/58
See application file for complete search history.

(56) References Cited

U.S. PATENT DOCUMENTS

| | | | | |
|---|---|---|---|---|
| 8,535,075 | B1 | 9/2013 | Golko et al. | |
| 8,591,238 | B2 * | 11/2013 | Zhang | H01R 13/422 439/607.35 |
| 9,093,781 | B2 * | 7/2015 | Liu | H01R 13/6205 |
| 9,444,207 | B1 * | 9/2016 | Smith | H01R 31/065 |
| 9,525,227 | B2 * | 12/2016 | Little | H01R 13/6273 |
| 9,722,376 | B2 * | 8/2017 | Kim | H01R 13/6616 |
| 2014/0141635 | A1 * | 5/2014 | Saunders | H01R 29/00 439/170 |
| 2014/0141636 | A1 * | 5/2014 | O'Leary | H02G 5/007 439/213 |

* cited by examiner

*Primary Examiner* — Xuong M Chung Trans
(74) *Attorney, Agent, or Firm* — Li & Cai Intellectual Property (USA) Office

(57) ABSTRACT

An adapter for connecting to a connector in a first direction is provided. The adapter includes a plurality of signal pins, arranged in a loop, a power pin, configured to transmit a power signal to the connector, and a detection circuit, coupled to the power pin and the plurality of signal pins. A feedback signal is provided by the connector in response to the power signal that is transmitted through one of the plurality of signal pins, and an interface of the connector is identified by the detection circuit and a pin order of the adapter is defined by the detection circuit according to the feedback signal.

13 Claims, 11 Drawing Sheets

ADAPTER AND ELECTRONIC DEVICE HAVING THE ADAPTER

1. FIELD OF THE INVENTION

The present disclosure relates to an adapter and an electronic device having that adapter; more particularly, to an improved adapter and an electronic device having the improved adapter.

2. DESCRIPTION OF RELATED ART

Adapters and connectors are commonly used on almost every electronic device. For example, earphones are connected with portable devices through earphone jacks either two-rings or three-rings, power cables are manufactured with USB (universal serial bus) connectors, no matter what the USB types are (e.g., Type-A, Type-B or Type-C).

USB Type-C, commonly known as simply USB-C, is a 24-pin USB connector system allowing transmission of data and power. USB Type-C, with its specifications first published in 2014, is the newest generation for USB connectors, and is the emerging standard for charging and transmitting data. USB Type-C is included in electronic devices like the latest laptops, phones, and tablets. One of the breakthroughs is, among other things, and as opposed to Type-A and Type-B which can be plugged in only one way, that USB Type-C is bi-directional.

USB Type-C is bi-directional, which means it is reversible, so that to flip the connector around looking for the correct orientation as happened in Type-A or Type-B plug no longer exists. Nevertheless, the pin definitions of USB Type-C are defined for single interface and the plug-in direction is limited to bi-directional.

SUMMARY OF THE INVENTION

An adapter is provided in the present disclosure, and the adapter is provided with an improved configuration. The adapter as provided in the present disclosure is multi-directional, and a connector can be plugged into the adapter in multi directions when the adapter is connecting with the connector.

In an embodiment of the present disclosure, an adapter for connecting with a connector is provided. The adapter for connecting with a connector includes a plurality of signal pins, arranged in a loop, a power pin, configured to transmit a power signal to the connector, and a detection circuit, coupled to the power pin and the plurality of signal pins. A feedback signal is provided by the connector according to the power signal. The feedback signal is transmitted through one of the plurality of signal pins, and an interface of the connector is identified by the detection circuit and a pin order of the adapter is defined by the detection circuit according to the feedback signal.

In the present embodiment, the adapter preferably further includes an adapter housing, and a plurality of ground pins. The plurality of ground pins and the plurality of signal pins are interleavingly-arranged on one of an inner surface and an outer surface of the adapter housing. The power pin is arranged at a center of the adapter housing.

In another embodiment of the present disclosure, an adapter for connecting with a connector is provided. The adapter for connecting with a connector includes a plurality of signal pins; a plurality of ground pins; a plurality of power pins configured to transmit a power signal to the connector; and a detection circuit, coupled to the plurality of power pins and the plurality of signal pins. The plurality of signal pins, the plurality of ground pins and the plurality of power pins are interleavingly-arranged. A feedback signal provided by the connector according to the power signal is transmitted to one of the plurality of signal pins. An interface of the connector is identified by the detection circuit and a pin order of the adapter is defined by the detection circuit according to the feedback signal.

In the present embodiment, the adapter preferably further includes an adapter housing. The plurality of ground pins, the plurality of power pins and the plurality of signal pins are interleavingly-arranged on one of an inner surface and an outer surface of the adapter housing.

An electronic device with an adapter is provided in the present disclosure, and the adapter is provided with an improved configuration. The adapter on the electronic device as provided in the present disclosure is multi-directional, and a portable device can be connected with the electronic device through plugging a connector into the adapter on the electronic device in multi directions when the connector is connecting with the electronic device.

Therefore, in one another embodiment of the present disclosure, an electronic device is provided. The electronic device includes a receptacle adapter, having a plurality of signal pins and a power pin, in which the plurality of signal pins are arranged in a loop, and the power pin is configured to transmit a power signal and the receptacle adapter is configured to receive a corresponding plug connector, and a detection circuit, coupled to the power pin and the plurality of signal pins, in which a feedback signal is provided by the connector according to the power signal. The feedback signal is transmitted through one of the plurality of signal pins in response to the corresponding plug connector being accommodated in the receptacle connector. An interface of the connector is identified by the detection circuit and a pin order of the adapter is defined by the detection circuit according to the feedback signal.

In order to further understand the present disclosure, the following embodiments are provided along with illustrations to facilitate the disclosure of the present disclosure.

DETAILED DESCRIPTION OF THE PREFERRED EMBODIMENTS

The aforementioned illustrations and following detailed description are exemplary for the purpose of further explaining the scope of the present disclosure. Other objectives and advantages related to the present disclosure will be illustrated in the following description and appended drawings.

Figure 1:
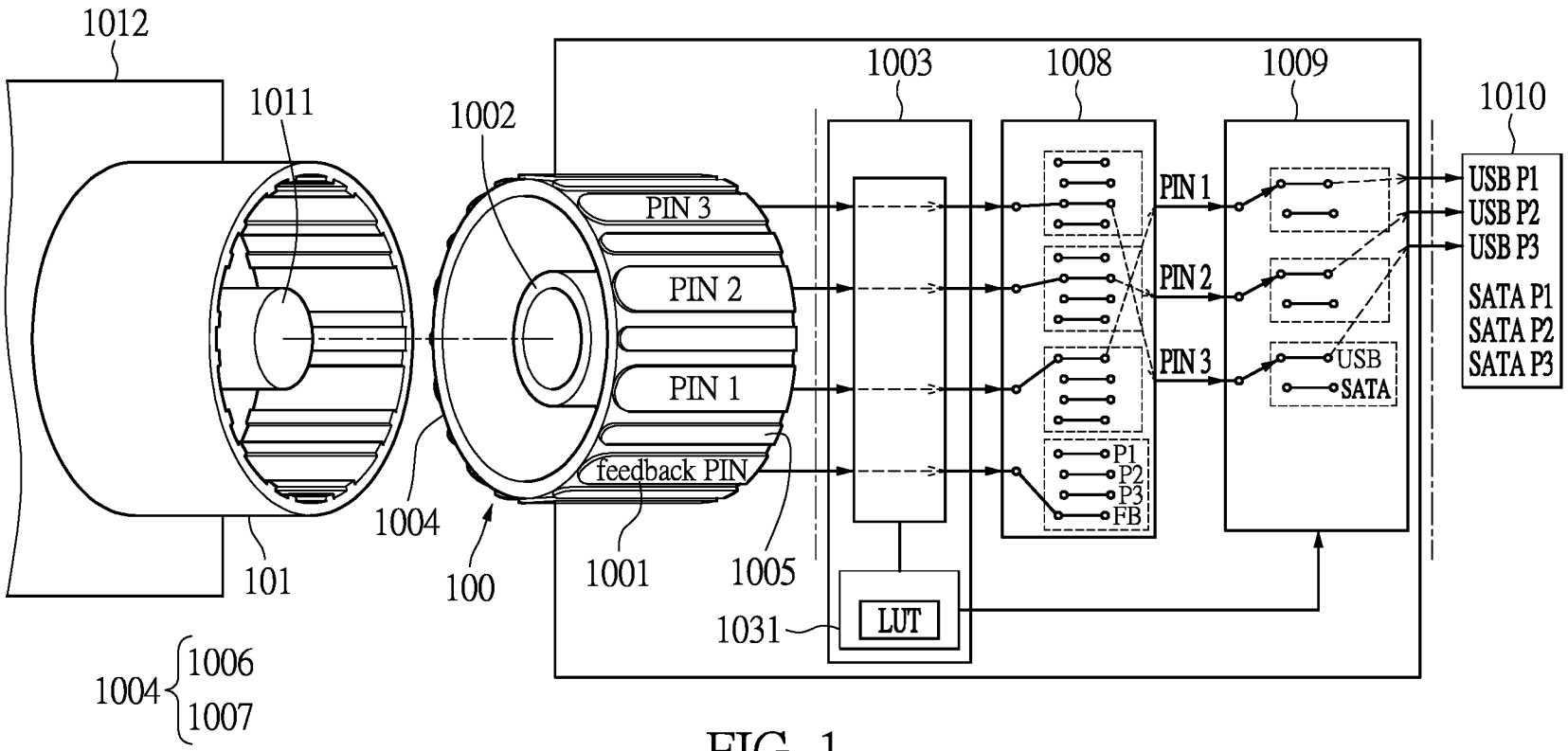
FIG. 1 is a schematic view illustrating the adapter for connecting with a connector according to one of the embodiments of the present disclosure.

Reference is firstly made to FIG. 1, which is a schematic view illustrating the adapter for connecting with a connector according to one of the embodiments of the present disclosure. As shown in FIG. 1, an adapter 100 is for connecting with a connector 101. The adapter 100 includes a plurality of signal pins 1001, a power pin 1002 and a detection circuit 1003. Please note that the plurality of signals pins includes PIN 1, PIN 2, . . . PIN X and feedback PIN, in which X is the number of pins the adapter 100 supports. The power pin 1002 is configured to transmit a power signal to the connector 101. The plurality of signal pins 1001 are arranged in a loop. The detection circuit 1003 is coupled to the plurality of signal pins 1001 and the power pin 1002. After the connector 101 is plugged into the adapter 100, the detection circuit 1003 can detect that the connector 101 is plugged into the adapter 100, and the power signal is controlled by the detection circuit 1003 and is transmitted through the power pin 1002 to the plugged-in connector 101.

The connector 101 includes a power signal receiving pin 1011, which would, by the respective mechanical designs of both the adapter 100 and the connector 101, correspondingly connect with the power pin 1002 of the adapter 100. The power signal receiving pin 1011 receives the power signal transmitted from the adapter 100, and then the connector 101 generates a feedback signal in response to the power signal. The feedback signal is transmitted from the connector 101 through one of the plurality of signal pins 1001. In the present embodiment, the one among the signal pins 1001 which receives the feedback signal is labeled as "feedback pin" as shown in FIG. 1.

The feedback signal has a certain voltage level, and the voltage level is relative to an interface of the connector 101. When the adapter 100 receives the feedback signal, the interface the connector 101 is identified by the detection circuit 1003 according to the voltage level of the feedback signal, and a pin order of the plurality of the signal pins 1001 can be defined by the detection circuit 1003 according to the feedback signal. That is, since the plurality of signal pins 1001 are arranged in a loop, and since that one among the plurality of signal pins 1001 that receives the feedback signal is defined as the feedback pin, the pin order is defined clockwisely or counter clockwisely from the feedback pin.

To be more specific, one of the signal pins 1001 that is arranged either to the left or to the right of the feedback pin would be defined as PIN 1, and so on. For example, one of the signal pins 1001 at the left side of the feedback pin is defined as PIN 1, the next one of the signal pins 1001 arranged at the left side of PIN 1 is then defined as PIN 2, the next one of the signal pins 1001 arranged at the left side of PIN 2 is then defined as PIN 3, and so on. Ultimately, the loop-arranged signal pins 1001 would each be given a single pin number PIN X, where the pin number ranges from PIN 1 to Pin X (X depends on the number of the pins the adapter has). Once the feedback pin is determined, each of the plurality of signal pins 1001 can be defined to match the interface of the connector 101, i.e., the pin order is thus defined.

One with ordinary skill in the art can thus comprehend that the reason that the plurality of signal pins 1001 are arranged in order is because the pin order of those signal pins 1001 can be only determined as long as the feedback pin is determined (or, is located or positioned). In this respect, the loop needs not to be a circle. For other examples, FIGS. 2 and 3 illustrate other configurations for the adapter of the present disclosure.

One with ordinary skill in the art can further understand that the detection circuit 1003, which functions to identify what the interface the connector 101 is and to define the pin order, may include a processor (e.g., CPU) executing corresponding codes to perform identifying an interface of connector 101 and defining pin order functionalities. The processor, though not shown in the figure, may be embedded in the detection circuit 1003; it may also be an independent element or device co-functioning with the detection circuit 1003 taking care of identifying an interface of connector 101 and defining pin order functionalities.

Figure 2:
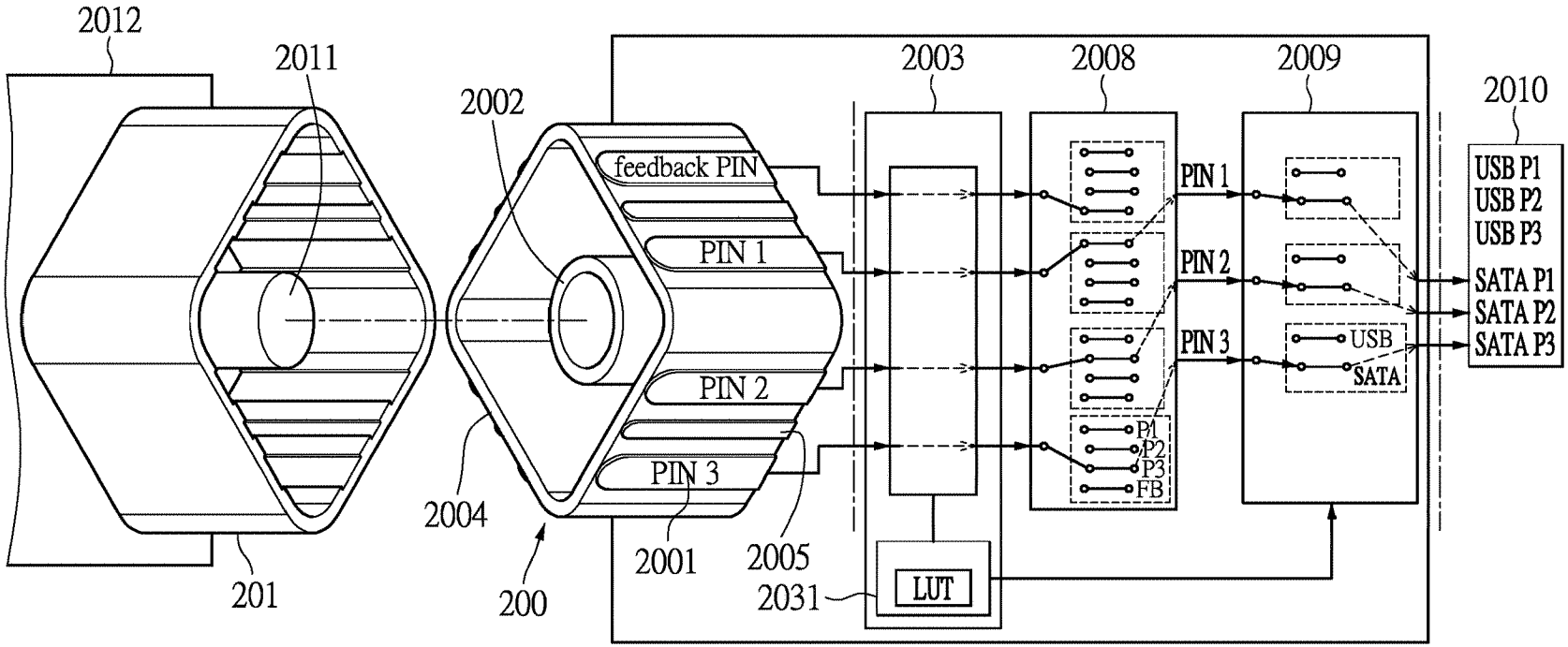
FIG. 2 is a schematic view illustrating the adapter for connecting with a connector according to one of the embodiments of the present disclosure.
Figure 3:
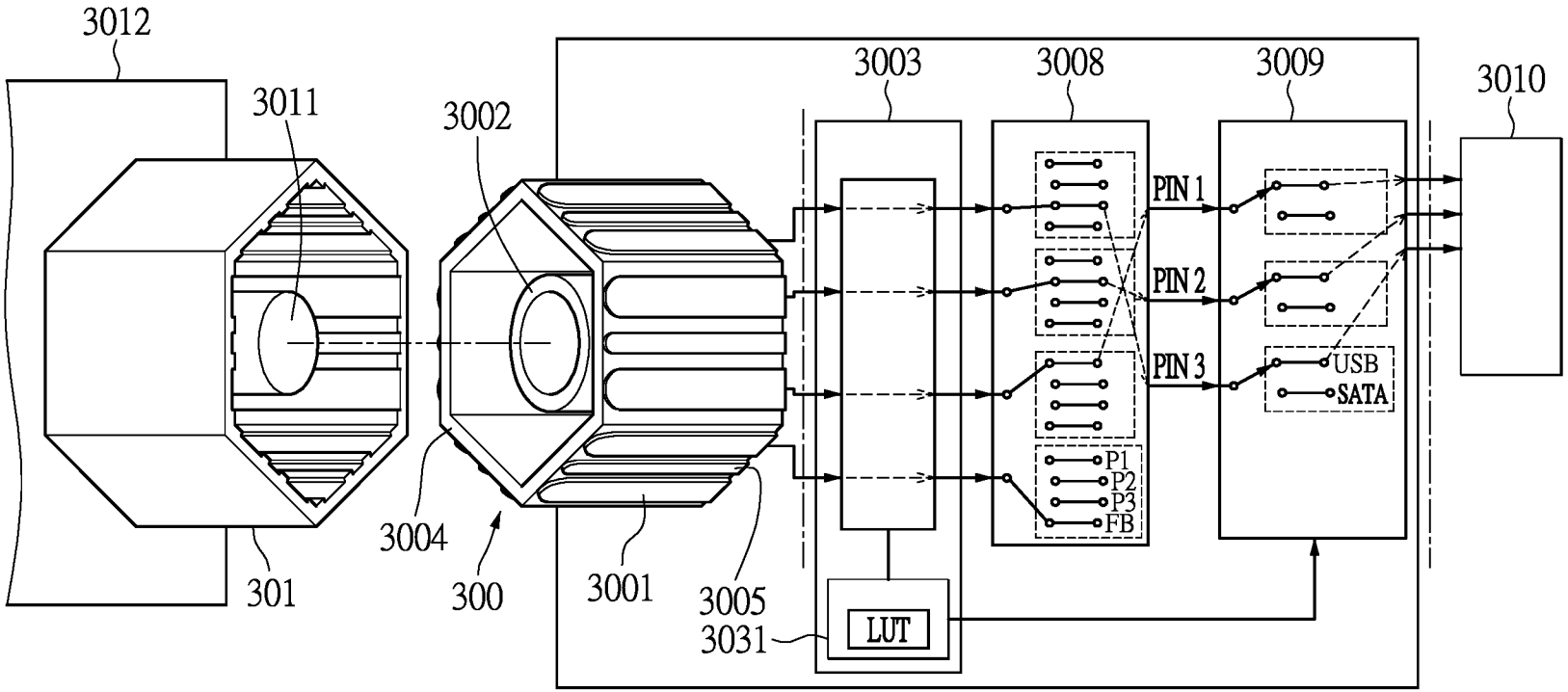
FIG. 3 is a schematic view illustrating the adapter for connecting with a connector according to one of the embodiments of the present disclosure.

FIG. 2 is a schematic view illustrating the adapter for connecting with a connector according to one of the embodiments of the present disclosure, and FIG. 3 is, also, a schematic view illustrating the adapter for connecting with a connector according to one of the embodiments of the present disclosure. In FIG. 2, the plurality of signal pins 2001 of the adapter 200 are arranged in a loop and the loop is in a square shape. The connector 201 which is connected to the adapter 200 is in a corresponding square shape with the adapter 200 to be plugged into the adapter 200. The square shape loop is a closed loop. After the connector 201 is plugged into the adapter 200, the power signal is controlled by the detection circuit 1003 and is transmitted through the power pin 1002 to the plugged-in connector 101.

The connector 201 includes a power signal receiving pin 2011, which is correspondingly connected with the power pin 2002. The power signal receiving pin 2011 receives the power signal transmitted from the adapter 200, and the connector 201 generates a feedback signal in response to the power signal. The feedback signal is transmitted from the connector 201 to one of the plurality of signal pins 2001. In the present embodiment, that signal pin 2001 which received the feedback signal is labeled as "feedback pin" as shown in FIG. 2.

The signal pin 2001 that is arranged either to the left or to the right of the feedback pin would be defined as PIN 1, and so on. For example, in the present embodiment, the signal pin 2001 at the right side of the feedback pin is defined as PIN 1, the next signal PIN 2001 arranged at the right side of PIN 1 is then defined as PIN 2, the next signal pin 2001 arranged at the right side of PIN 2 is then defined as PIN 3, and so on. Ultimately, the loop-arranged signal pins 2001 would each be given a single pin number PIN X, where the pin number ranges from PIN 1 to Pin X (X depends on the number of the pins the adapter has). Once each of the plurality of signal pins is defined, the pin order is thus determined.

FIG. 3 illustrates another example for a different configuration of the adapter. In FIG. 3, the plurality of signal pins 3001 of the adapter 300 are arranged in a loop and the loop is in a hexagonal shape. The connector 301 which is connected to the adapter 300 is in a corresponding hexagonal shape with the adapter 300 to be plugged into the adapter 300. The square shape loop is a closed loop. After the connector 301 is plugged into the adapter 300, the detection circuit 3003 then controls the adapter 300 to transmit the power signal, as mentioned above, which is transmitted on the power pin 3002, to the connector 301.

The implementations for the embodiment of FIG. 3 are substantially the same as those of FIG. 1 and FIG. 2, whereas the plurality of signal pins 3001 being arranged in hexagonal shape is one of the differences therebetween. The details are thus omitted accordingly for the sake of brevity. As long as the feedback pin is determined, the pin order of the present embodiment can thus be defined.

Referring once again to FIGS. 1-3, people with ordinary skill in the art can understand that the loop is not limited to a circular shape. The loop can also be in square shape or in hexagonal shape. The loop can even be such as an irregular shape. Furthermore, from FIGS. 1-3, it can be seen that the power pin is surrounded by the plurality of signal pins.

Reference is once again made to FIG. 1, in which the adapter 100 further includes an adapter housing 1004 and a plurality of ground pins 1005. The adapter housing 1004 in the present embodiment is in a round shape, and has an inner surface 1006 and an outer surface 1007. The circular loop-arranged signal pins 1001 are arranged on the outer surface 1007 of the adapter housing 1004, in the present embodiment as shown in FIG. 1. It can also be seen that the plurality of ground pins 1005 and the plurality of signal pins 1001 are interleavingly-arranged on the outer surface 1007 of the adapter housing 1004. In other words, for example, one ground pin 1005 is arranged at the right side of one signal pin 1001, and then another signal pin 100 is arranged at the right side of that ground pin 1005. Therefore, the plurality of ground pins 1005 and the plurality of signal pins 1001 are interleavingly-arranged in a close loop. The power pin 1002 is substantially arranged at a center (not labeled in the figure) of the adapter housing 1004. When the connector 101 is plugged into the adapter 100, the power signal receiving pin 1011 can thereby match with the power pin 1002, and a signal transmission path is thus created.

An opening, though not labeled in the figure, but can be seen at a certain angel, is further defined on the adapter housing 1004, and the plurality of signal pins 1001 and the plurality of ground pins 1005 are closer to the opening than the power pin 1002 is. To be more precise, as shown in FIG. 1, the opening being formed on the adapter 1004, each of the plurality of signal pins 1001 and each of the ground pins 1005 align with the opening, but the power in 1002 dose not. The power pin 1002 is arranged inwardly than the signal pins 1001 and the ground pins 1005 are. By the structural design, when the connector 101 is plugged into the adapter 100, the plurality of signal pins 1001 and the plurality of ground pins 1005 would be in contact with the connector 101 before the power pin 1002 touches the power signal receiving pin 1011. In other words, the power pin 1002 is withdrawn back relative to the plurality of signal pins 1001 and the plurality of ground pins 1005. The structural design ascertains that the power contact between the connector 101 and the adapter 100 would be later than the signal contact and the ground contact, which further provides an electronic safeguard for both of the connector 101 and the adapter 100, so as making sure that the grounding is established before the power connection is.

Figure 4:
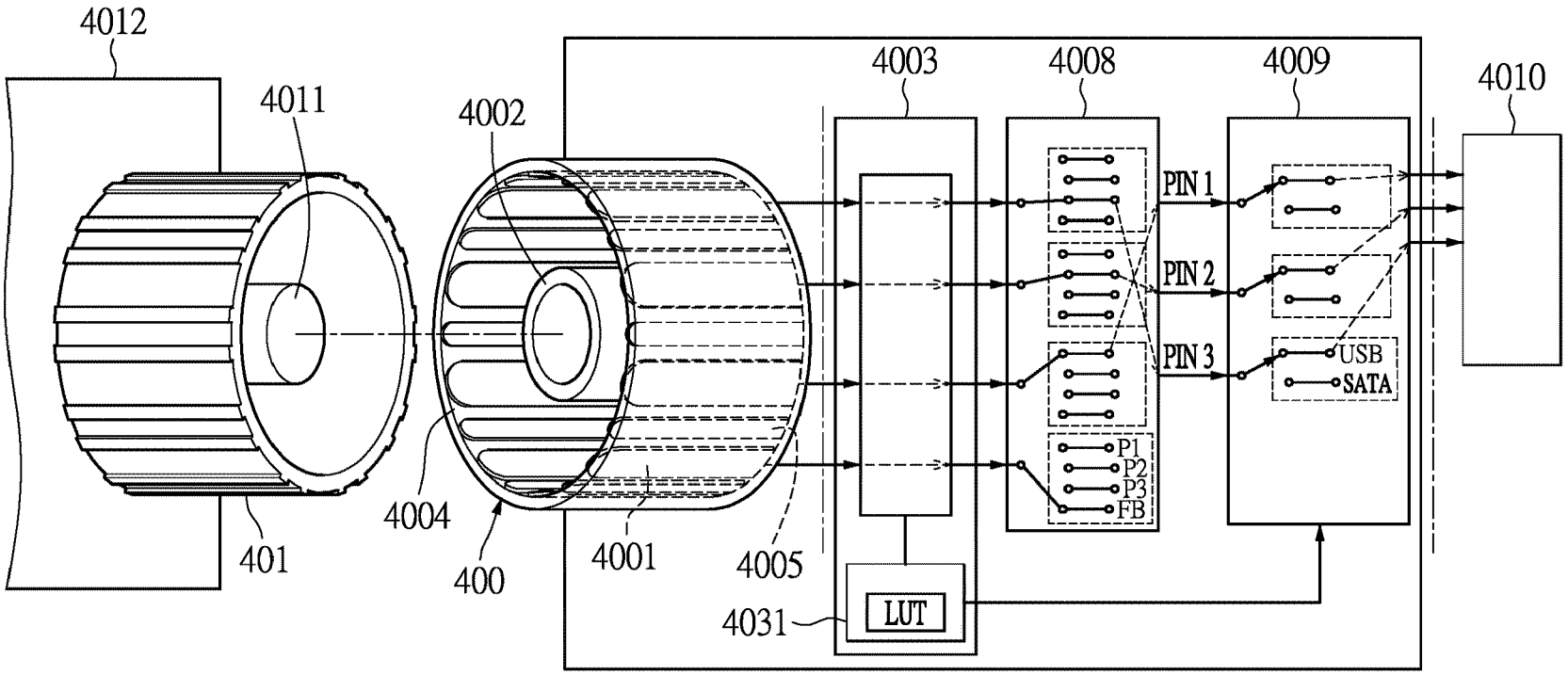
FIG. 4 is a schematic view illustrating the adapter for connecting with a connector according to one of the embodiments of the present disclosure.

In one another embodiment, reference is next made to FIG. 4, which is a schematic view illustrating the adapter for connecting with a connector according to one of the embodiments of the present disclosure. In FIG. 4, the adapter 400 further includes an adapter housing 4004, a power pin 4002, a plurality of signal pins 4001 and a plurality of ground pins 4005. The adapter housing 4004 in the present embodiment is in a round shape, and has an inner surface 4006 and an outer surface 4007. The circular loop-arranged signal pins 4001 are arranged on the inner surface 4006 of the adapter housing 4004, in the present embodiment as shown in FIG. 4. It can also be seen that the plurality of ground pins 4005 and the plurality of signal pins 4001 are interleavingly-arranged on the inner surface 4006 of the adapter housing 4004. The plurality of ground pins 4005 and the plurality of signal pins 4001 are interleavingly-arranged on the outer surface 4007 one by one. In other words, for example, one ground pin 4005 is arranged at the right side of one signal pin 4001, and then another signal pin 400 is arranged at the right side of that ground pin 4005. Therefore, the plurality of ground pins 4005 and the plurality of signal pins 4001 are interleavingly-arranged in a close loop. The power pin 4002 is substantially arranged at a center (not labeled in the figure) of the adapter housing 4004. When the connector 401 is plugged into the adapter 400, the power signal receiving pin 4011 can thereby match with the power pin 4002, and a signal transmission path is thus created.

Figure 5:
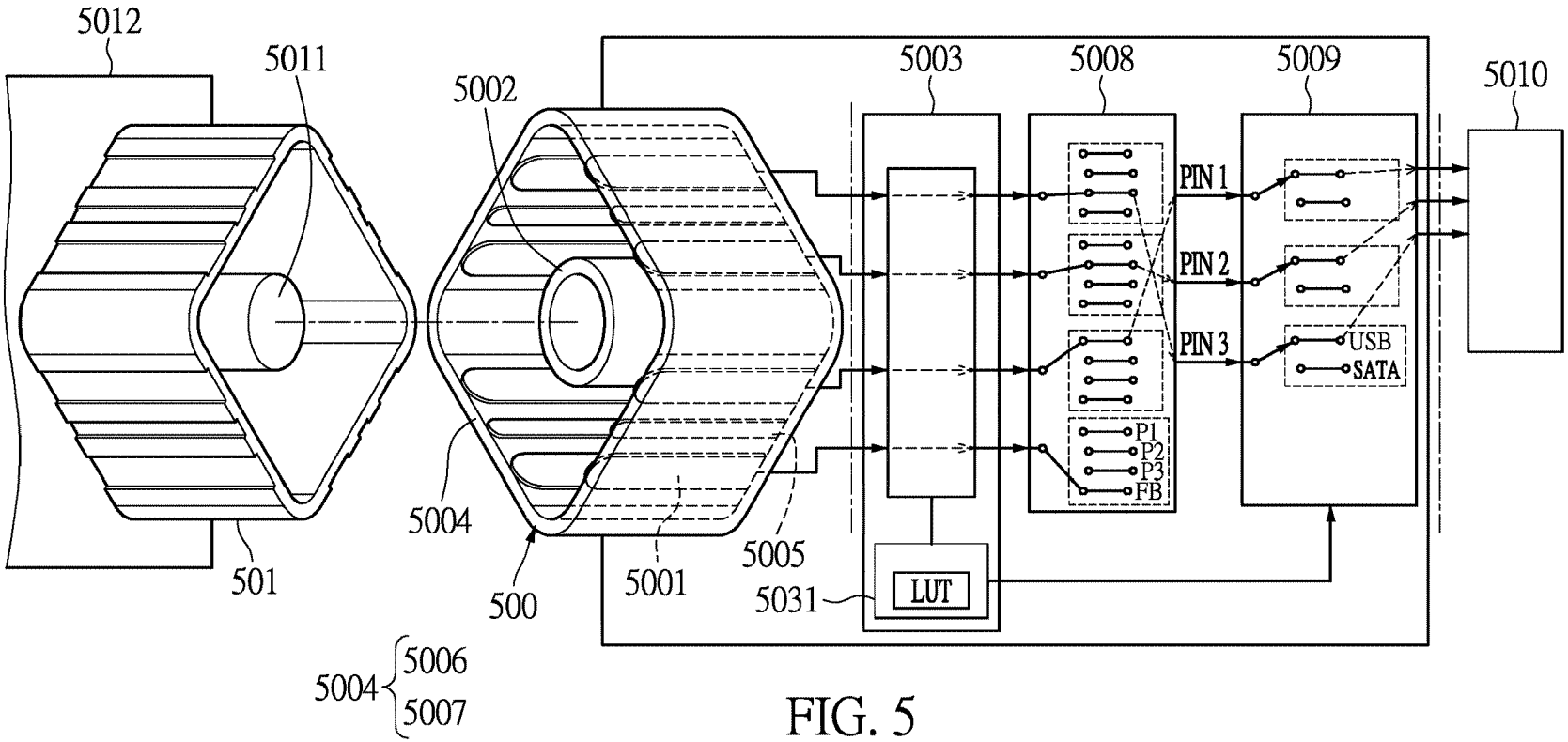
FIG. 5 is a schematic view illustrating the adapter for connecting with a connector according to one of the embodiments of the present disclosure.
Figure 6:
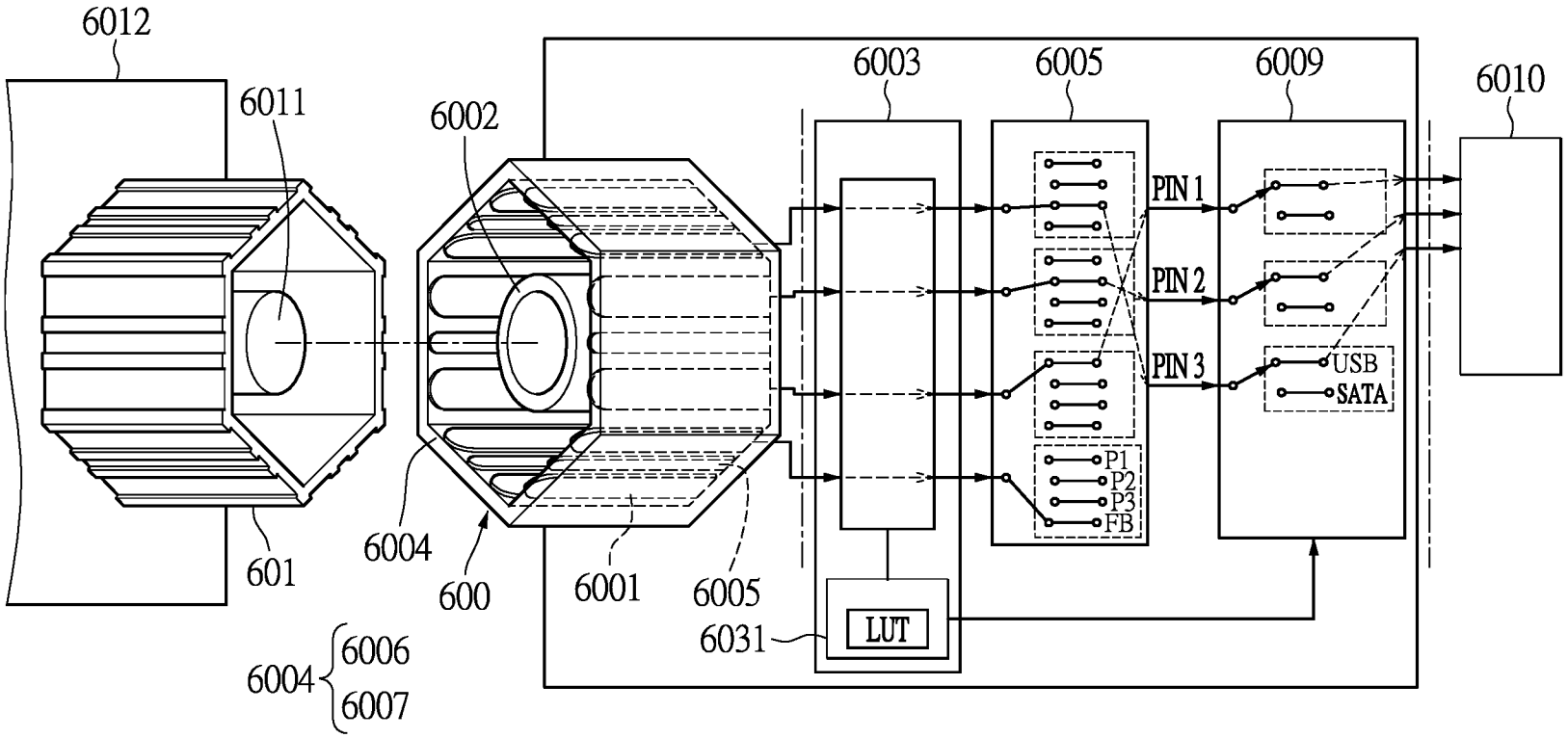
FIG. 6 is a schematic view illustrating the adapter for connecting with a connector according to one of the embodiments of the present disclosure.

More exemplified embodiments are revealed in FIGS. 5 and 6, where FIGS. 5 and 6 are respectively a schematic view illustrating the adapter for connecting with a connector according to one of the embodiments of the present disclosure.

Reference is made to FIGS. 5-6, in which the adapters 500, 600 include an adapter housings 5004, 6004 and a plurality of ground pins 5005, 6005. The adapter housings 5004, 6004 in the present embodiments are respectively in a square shape and a hexagonal shape. The adapter housing 5004 has an inner surface 5006 and an outer surface 5007 while the adapter housing 6004 has an inner surface 6006 and an outer surface 6007. The square loop-arranged signal pins 5001 are arranged on the inner surface 5006 of the adapter housing 5004, in the present embodiment as shown in FIG. 5, while the hexagonal loop-arranged signal pins 6001 are arranged on the inner surface 6006 of the adapter housing 6004, in the present embodiment as shown in FIG. 6.

Referring once again to FIGS. 1-6, people with ordinary skill in the art can understand that the arrangement for the plurality of signal pins and the plurality ground pins is not limited. They can be arranged on the outer surface of the adapter housing of the adapter, as depicted in FIGS. 1-3 or on the inner surface of the adapter housing of the adapter, as depicted in FIGS. 4-6, regardless what the shape of the adapter housing is.

That is to say, those with ordinary in the art can, by various practical demands, pick up a certain kind of arrangement for optimal design based on the disclosures from FIGS. 1-6. So along as the connector and the adapter can be correspondingly connected, regardless what the shapes of the connector and the adapter are, and the inner surface or outer surface the plurality of signal pins and the plurality ground pins are arranged.

Reference is once again made back to FIG. 1. The connector 101 may belong to any kinds of interface, for example, the connector 101 may be a USB connector or a SATA (serial advanced technology attachment) connector as can be seen in FIG. 1. The connector 101 can further be, though not shown in FIG. 1, an HDMI (high definition multimedia interface) connector. After the connector 101 is plugged into the adapter 101, what interface of the connector 101 is should be identified by the adapter 100 before data can be transmitted. Precisely speaking, after the connector 101 with a certain type of interface is plugged into the adapter 100, in the present embodiment for example, the connector 101 is a USB 3.0 connector, the connector 101 contacts the plurality of signal pins 1001 and the plurality of ground pins 1005 first, and then the power signal receiving pin 1011 and the power pin 1002 connect with each other next.

The power signal is then transmitted from the power pin 1002 of the adapter 100 to the connector 101. After receiving the power signal, the connector 101 then generates the feedback signal in response to the power signal and then transmits the feedback signal to the adapter 100, meaning that the connection between the adapter 100 and connector 101 is good. The feedback signal would have a different voltage level which is relevant to the interface of the connector 11. In the present embodiment, since the connector 101 is a USB 3.0 connector, the voltage level of the feedback signal is 3V accordingly. In another embodiment, for example that the connector 101 is a SATA connector, the voltage level of the feedback signal would then be 1V accordingly.

At the connector 101 side as shown in FIG. 1, the connector 101 includes a feedback circuit 1012. The feedback circuit 1012 generates the feedback signal after the connector 101 receives the power signal. More details will be described in the followings.

Figure 7:
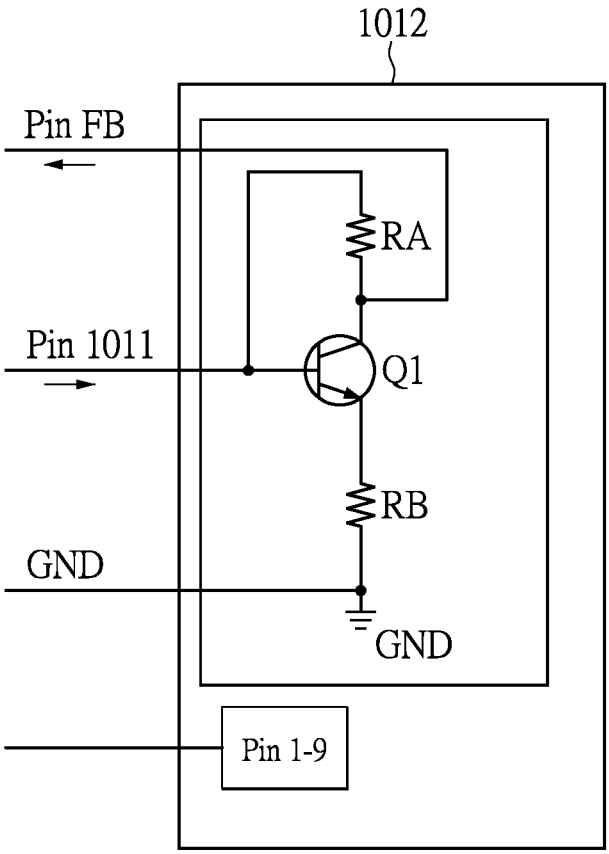
FIG. 7 is the schematic view illustrating one embodiment of the feedback circuit.

Reference is collectively made to FIGS. 1 and 7, where FIG. 7 is the schematic view illustrating one embodiment of the feedback circuit 1012. The feedback circuit 1011 includes a first resistor $R_A$, a second resistor $R_B$ and a transistor Q1. As can be seen in FIG. 7, the transistor Q1 is coupled with the first resistor $R_A$ and the second resistor $R_B$, the other end of the second resistor $R_B$ is connected to a ground GND. As mentioned above, the power signal receiving pin 1011 of the connector 101 receives the power signal from the adapter 100. The power signal is further passed to the feedback circuit 1021 through pin 1011 (as shown in FIG. 7). The voltage of the power signal in the present embodiment is 5V, and the voltage of Pin FB is [RB/(RA+RB)]*5V. The feedback signal would be outputted by the feedback circuit 1012 on Pin FB (as shown in FIG. 7), and the feedback signal will further be transmitted to the adapter 100 by the connector 101. The transistor Q1 can be, but not limited to, a bipolar junction transistor (BJT) or a metal oxide semiconductor field effect transistor (MOSFET).

Figure 8:
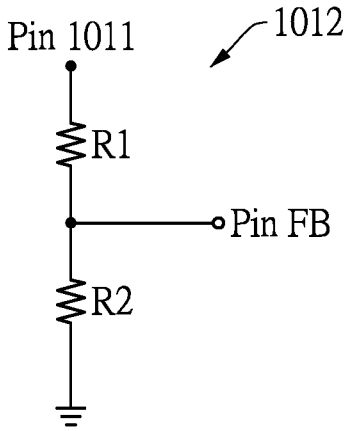
FIG. 8 is the schematic view illustrating another embodiment of the feedback circuit.

Reference is next made to FIGS. 1 and 8, where FIG. 8 is the schematic view illustrating another embodiment of the feedback circuit. The feedback circuit 1012 can also be implemented by the voltage divider as shown in FIG. 8, in which the power signal is transmitted through Pin 1011 and the feedback signal is transmitted through Pin FB. Accordingly, the voltage of the feedback signal is [R2/(R1+R2)]*5V. One of the differences between the feedback circuits of FIG. 7 and FIG. 8 is that there is no transistor used in the feedback circuits of FIG. 8. Since the theory and other details of voltage divider are well known to those with ordinary skill in the art, the relevant descriptions are omitted for the sake of brevity.

The adapter 100 can then identify the interface of the connector according to the voltage level of the feedback signal. Table 1 listed below is referred to collectively for better understanding of how the interface is identified.

TABLE 1

| Interface | Voltage input | Voltage output |
|---|---|---|
| USB3.0 | 5 V | 3 V |
| SATA | 5 V | 1 V |
| HDMI | 5 V | 2 V |

Referring to FIG. 1, the detection circuit 1004 includes a memory circuit 1031. Table 1 is a look-up table (LUT) stored in the memory circuit 1031. In the LUT, multiple voltage levels corresponding to different types of interface are stored. To be more specific, after the adapter 100 receives the feedback signal, preferably, the detection circuit 1003 would detect the voltage level of the feedback signal. After the voltage level is detected, the detected voltage level corresponds to which kind of interface would be identified by the detection circuit 1003 via the LUT. In the present embodiment, when a connector is plugged into the adapter 100, the detection circuit 1003 detects the voltage level of the feedback signal to be 3V, the interface of the connector 101 that is plugged into the adapter 100 can be identified as a USB 3.0 connector by the detection circuit 1003 via the LUT stored in the memory circuit 1031.

It can be understood that, in another embodiment, if the detection circuit 1003 detects the voltage level of the feedback signal to be 1V, then the detection circuit 1003 can thus identify that the interface of the connector 101 that is plugged into the adapter 100 is an SATA connector. It should be noted that the implementation of the LUT is not limited. Preferably, the LUT is programmed in a memory circuit 1031 of the detection circuit 1003. The memory circuit 1031 can also be programmed directly in the detection circuit 1003. The present disclosure does not limit how the LUT is implemented, and thus no limitations should be imposed to the present disclosure.

Table 2 listed below illustrates the pin definition of a USB 3.0 connector according to the embodiment of the present disclosure.

TABLE 2

| Pin1011 | 1 | 2 | 3 | 4 | 5 |
|---|---|---|---|---|---|
| Power | VBUS | D− | D+ | GND | StdA_SSRX− |
| Pin1011 | 6 | 7 | 8 | 9 | Pin FB |
| Power | StdA_SSRX+ | GND_DRAIN | StdA_SSTX− | StdA_SSTX+ | Feedback |

Table 2 can be stored, but not limited to, in the memory circuit 1031. Referring to table 2, the numbers 1-9 are original pin definitions of an USB 3.0 connector. By original, it means the bi-directional USB 3.0 connector. Since the USB 3.0 connector of the present disclosure is made in a circular, square, hexagonal or other kinds of shape, as can be seen in table 2, two extra pins Pin 1011 and Pin FB are added. That is to say, at the connector 101 side, Pin 1011 is for receiving the power signal, and Pin FB is for transmitting the feedback signal. After all the pre-transmission settlements are done, correct signals can be transmitted over Pins 1-9.

Table 3 listed below illustrates the pin definition of a SATA connector according to the embodiment of the present disclosure.

| Pin1011 | 1 | 2 | 3 | 4 | 5 |
|---|---|---|---|---|---|
| Power | GND | A+ | A− | GND | B− |
| Pin1011 | 6 | 7 | 8 | 9 | Pin FB |
| Power | B+ | GND | NC | NC | Feedback |

Table 3 can be stored, but not limited to, in the memory circuit 1031. Referring to table 3, the numbers 1-7 are original pins of a SATA connector. By original, a SATA connector has seven pins for transmission. That is, as can be seen in in table 3, Pin 1 to Pin 7. Pins 8 and 9 are non-connected (labeled as NC) pins, that is because the connector 101 can be a USB 3.0 connector or a SATA connector, and when the connector 101 functions as a SATA connector pin 8 and pin 9 need not to transmit any signal, and they will be disabled in the instance.

One with ordinary skill can realize that, the connector 101 of the present embodiment can be a connector with any kinds of interface. As long as added with two extra pins, and that is Pin 1011 for receiving power signal and Pin FB for transmitting feedback signal. For example, if a connector with a certain type of interface has 12 pins, the connector would have extra Pin 1011 and Pin FB when the connector is arranged in a circular shape as the embodiment of the present disclosure, in which Pin 1011 is for receiving the power signal and Pin FB is for transmitting the feedback signal.

The pins on the connector 101 are pre-defined. However, this is not the case for the adapter 100. The following would explain in order to render a better understanding of this aspect. In plugging the connector 101 into the adapter 100, the connector 101 is plugged into the adapter 100 with arbitrary directions. That is, unlike the one-way connectors (e.g., USB Type-A or USB Type-B), the connector 101 of the present disclosure can be plugged into the adapter 100 in multiple angles. The pins on the connector 101 being pre-defined means that the connector 101 would have a particular pin for transmitting signals, including the feedback signal. That is to say, each connector would have a particular pin in charge of transmitting a particular signal. The pin of connector 101 for transmitting the feedback signal can be viewed, or in other words functions as a reference for location, and that is, no matter which one of the signal pins the adapter 100 is in contact with the pin where the feedback signal is transmitted on, that signal pin (i.e., the signal pin that receives the feedback signal) would be defined as the feedback pin.

In this regard, one with ordinary skill in the art can understand that, the pins on the connector 101 being pre-defined implies that the connector 101 would transmit the feedback signal at that particular pin after receiving the power signal come from the adapter 100. In contract to the pins (or pin order) of the adapter 100 being not pre-defined, the feedback pin of the adapter 100 can only be defined by which one of the signal pins 1001 is the one that is in contact with the pin of the connector 101 the feedback signal is transmitted on. Furthermore, due to the loop-arranged signal pins, once the feedback pin is found out, by the detection circuit 1003 in the present embodiment, the pin order of the signal pins 1001 can thus be fully defined, as mentioned above, clockwisely or counter-clockwisely. It can also be construed that, once the location of the feedback pin is positioned, the pin order of the signal pins 1001 can thus be fully defined, either clockwisely or counter-clockwisely. One should be noted that to clockwisely or counter-clockwisely define the pin order of the adapter 100 is not limited. It can be flexibly designed, in order to comply with the industry standard, to fit practical demands, or to meet certain criteria.

In one situation, the connector 101 is plugged into the adapter 100 by a user. According to the above descriptions, the interface of the connector 101 can be identified (e.g., USB 3.0 connector), and the pin order can be determined accordingly. The user then pulls the connector 101 out of the adapter 100, and then re-plugs the connector 101 back into the adapter 100, in a different direction (e.g., the user rotates the connector 180 degrees). After the connector 101 is re-plugged into the adapter 100, the adapter 100, also, under the control of the detection circuit 1003, transmits the power signal to the re-plugged in connector 101. The corresponding feedback signal is then generated and is transmitted on the particular pin of the connector 101 to the adapter 100. Since the connector 101 has been rotated 180 degrees, the location of the feedback pin on the adapter 100 would no longer be the same.

Continuing with this re-plugged situation, a pin order switching circuit then comes into play. As shown in FIG. 1, the adapter 100 further includes a pin order switching circuit 1008, the pin order switching circuit 1008 is electrically connected with the detection circuit 1003, and the detection circuit 1003 controls the pin order switching circuit 1008 for connecting the connector 101 with the adapter 100 after the pin order is defined. To be more specific, since the connector 101 has been rotated 180 degrees, the location of the feedback pin on the adapter 100 would be re-defined accordingly, and thus the pin order would also change correspondingly. The detection circuit 1003 would control the pin order switching circuit 1008 to switch each of the signal pins 1001 to its right pin order.

The adapter 100 as can be seen in FIG. 1, includes a control integrated circuit (control IC) 1010. In the present embodiment, the control IC 1010 is integrated with a USB 3.0 control IC (first control circuit) and a SATA control IC (second control circuit). If a USB 3.0 connector is plugged into the adapter 100, the pin order switching circuit 1008 will switch accordingly to the correct pin order. That is, the pin order switching circuit 1008 will switch to a first pin connection relationship (a USB 3.0 is plugged in) between the plurality of signal pins 1001 and a first control circuit (e.g., the USB 3.0 control IC of the control IC 1010). In that way, the USB 3.0 control IC can communicate with the USB 3.0 connector correctly, and thus the data transmission can be established.

Likewise, if a SATA connector is plugged into the adapter 100, the pin order switching circuit 1008 will switch accordingly to the correct pin order. That is, the pin order switching circuit 1008 will switch to a second pin connection relationship (a SATA is plugged in) between the plurality of signal pins 1001 and a second control circuit (e.g., the SATA control IC of the control IC 1010). In that way, the SATA control IC can communicate with the SATA connector, and thus the data transmission can be established.

The control IC 1010 of the present embodiment as shown in FIG. 1 is integrated with a USB 3.0 control IC and a SATA control IC; however, the present discloser should not be limited only to this scenario. One with ordinary skill in art can understand that the two ICs can be two independent and separated ICs, which means the two ICs need not to be integrated on one single IC. Moreover, the control IC 1010 can be integrated with more than two control ICs, each with different interface, e.g., the control IC can be integrated with a USB 3.0 control IC, a SATA control IC and a HDMI control IC. Details of how many control ICs can be integrated and whether to be integrated are omitted for the sake of brevity.

In another situation, the connector 101 is plugged into the adapter 100 by a user. According to the above descriptions, the interface of the connector 101 can be identified (e.g., USB 3.0 connector), and the pin order can be defined accordingly. The user then pulls the connector 101 out of the adapter 100, and then re-plugs a connector back into the adapter 100. In this situation, the user plugs a different connector into the adapter 100, for example, a SATA connector. After the SATA connector is plugged into the adapter 100, the adapter 100, also, under the control of the detection circuit 1003, transmits the power signal to the re-plugged in connector 101. The corresponding feedback signal with 1V voltage is then generated and is transmitted on the particular pin of the connector 101 to the adapter 100. The detection circuit 1003 identifies that the interface of the connector 101 is SATA according to the voltage level of the feedback signal. In other words, the detection circuit 1003 of the adapter 100 can identify that the interface of the connector 101 has changed from a USB 3.0 connector to a SATA connector.

Continuing with this interface-changing situation, an interface switching circuit then comes into play. As shown in FIG. 1, the adapter 100 further includes an interface switching circuit 1009. The interface switching circuit 1009 is electrically connected with the pin order switching circuit 1008 and the detection circuit 1003. Further in this situation, the detection circuit 1003 controls the interface switching circuit 1009 to match the connector 101 with the adapter 100 after the interface of the connector is identified. To be more specific, in responding a USB 3.0 connector being pulled out and a SATA connector being inserted in, the detection circuit 1003 can, by the procedure as described above, identifies that the interface of the connector 101 has changed, the detection circuit 1003 thereby controls the interface switching circuit 1009 to change the interface from a USB 3.0 interface to a SATA interface.

The interface switching circuit 1009 is in charge of switching the interface according to what type of the connector 101 is plugged in. For example, if a USB 3.0 connector is plugged into the adapter 100, the interface switching circuit 1009 would switch to a pin connection relationship (a USB 3.0 is plugged in) between the plurality of signal pins 1001 and a control circuit (e.g., the USB 3.0 control IC of the control IC 1010).

Preciously speaking, in the present embodiment, when a USB 3.0 connector 101 is plugged in, the pin order of the adapter 100 can be defined based on the above addressed descriptions, and the interface of the connector 101 can also be identified with respect to the above addressed descriptions. After the pin order is defined (as shown in FIG. 1, feedback PIN, PIN 1, PIN 2, PIN 3 and so on), the pin order switching circuit 1008 then comes into play, to switch the pin order to the correct connection. The feedback PIN on the adapter 100 is switched to FB of the pin order switching circuit 1008, PIN 1 is switch to P1, PIN 2 is switched to P2 and PIN 3 is switched to P3. Likewise, after the interface of the connector is identified, the interface switching circuit 1009 will switch to USB interface. The control IC 1010 will be switched correspondingly for further signal transmission.

Similarly principle can be applied to FIG. 2. In the embodiment as shown in FIG. 2, a SATA connector 201 is plugged into the adapter 200. The pin order of the adapter 200 can be defined based on the above addressed descriptions, and the interface of the connector 201 can also be identified with respect to the above addressed descriptions. After the pin order is defined (as shown in FIG. 2, feedback PIN, PIN 1, PIN 2, PIN 3 and so on), the pin order switching circuit 2008 then comes into play, to switch the pin order to the correct connection. The feedback PIN on the adapter 200 is switched to FB of the pin order switching circuit 1008, PIN 1 is switched to P1, PIN 2 is switched to P2 and PIN 3 is switched to P3. Likewise, after the interface of the connector is identified, the interface switching circuit 2009 will switch to SATA interface. The control IC 2010 will be switched correspondingly for further signal transmission.

People with ordinary skill in the art can realize that, when an adapter is manufactured or designed to support more than two interfaces, e.g., an adapter supporting USB and SATA interfaces or an adapter supporting USB, HDMI and SATA interfaces, the interface switching circuit as described above would be utilized to switch the interface for the adapter in order to connect with different connectors with different interfaces. However, when the adapter is manufactured or designed to support only one interface, e.g., a USB-dedicated socket or an HDMI-dedicated adapter, the interface switching circuit as described above will thus be an optional element.

Figure 9:
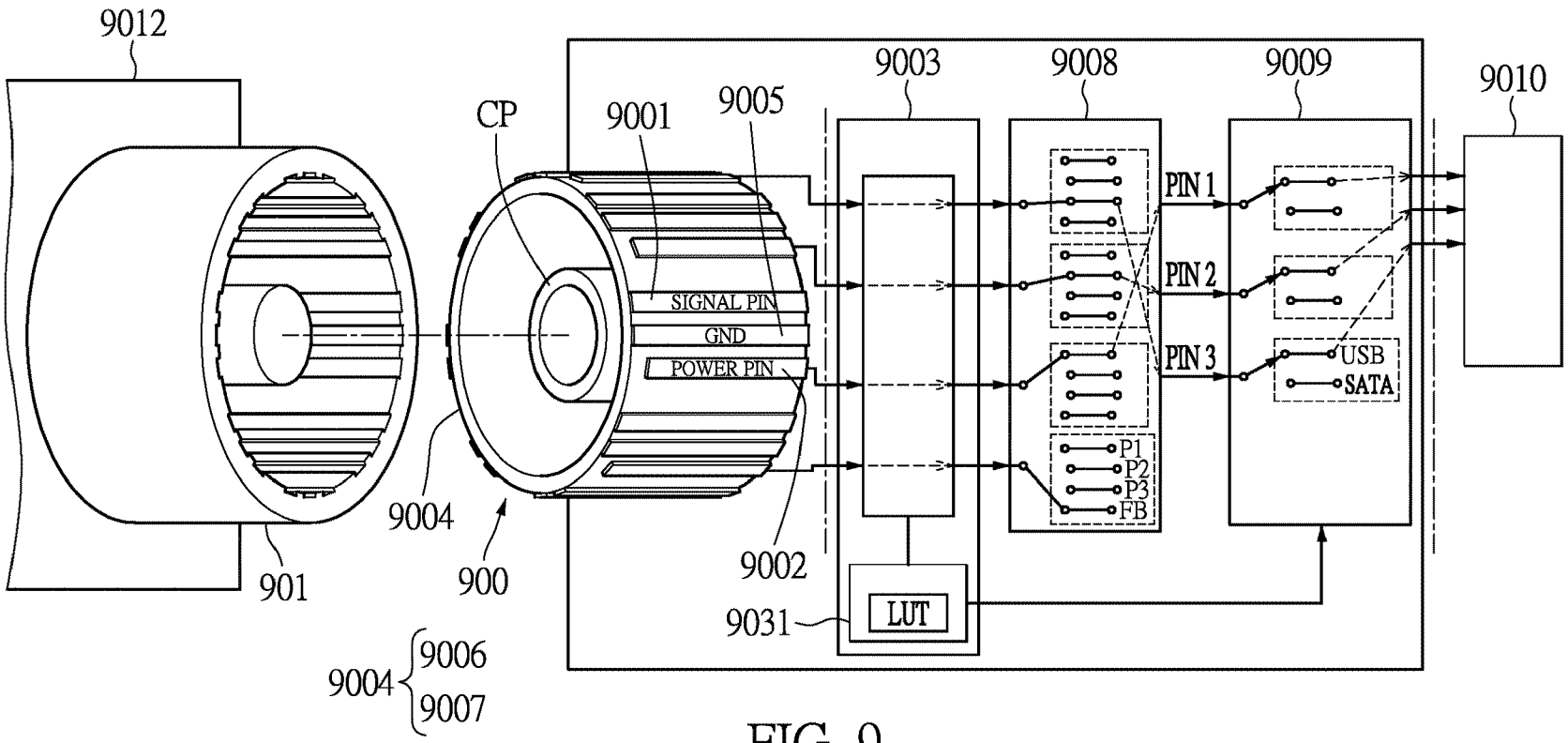
FIG. 9 is a schematic view illustrating the adapter for connecting with a connector according to one of the embodiments of the present disclosure.

Reference is next made to FIG. 9, which is a schematic view illustrating the adapter for connecting with a connector according to one of the embodiments of the present disclosure. As shown in FIG. 9, the adapter 900 for connecting with a connector includes a plurality of signal pins 9001, a plurality of power pins 9002, a plurality of ground pins 9005 and a detection circuit 9003. The plurality of power pins 9002 are configured to transmit power signals to the connector 901. The plurality of signal pins 9001, the plurality of ground pins 9005 and the plurality of power pins 9002 are arranged in a loop, and plurality of signal pins 9001, the plurality of ground pins 9005 and the plurality of power pins 9002 are interleavingly-arranged.

In the present embodiment as shown in FIG. 9, to be more precise, an opening is formed on the adapter 900. Each of the plurality of signal pins 9001 and the ground pins 9005 align with the opening, but the plurality of power pins 9002 do not. As can be seen in FIG. 9, the power pin 9002 is arranged not to align with the opening, which is a design that allows the power contact between the connector 901 and the adapter 900 would be later than the signal contact and the ground contact, which further provides an electronic safeguard for both of the connector 901 and the adapter 900, so as making sure that the grounding is established before the power connection is.

One signal pin 9001, one ground pin 9005 and one power pin 9002 could be viewed as a unit, as the labeled pins shown in FIG. 9 (SIGNAL PIN, GND and POWER PIN). In this regard, there will be several units arranged on the outer surface 9007 of the adapter housing 9004 of the adapter 900 (as addressed above, pins can also be arranged on the inner surface 9006 of the the adapter housing 9004 of the adapter 900). Taking the previous embodiment as example, if the connector 901 is a USB 3.0 connector and the adapter 900 is a corresponding adapter, then there will be eleven units arranged on the outer surface of the adapter 900, each with one signal pin 9001, one ground pin 9005 and one power pin 9002 arranged in the same order. That is to say, in the eleven units, each unit is arranged with one signal pin 9001, one ground pin 9005 and one power pin 9002 in order; or it can also be that in the eleven units, each unit is arranged with one ground pin 9005, one signal pin 9001 and one power pin 9002.

From the above description, one with ordinary skill in the art can understand that the order of how to arrange the pins in one single unit is not limited to only one certain scenario, so long as the three pins in every unit are arranged in the same order.

One should be noted is that the signal pin 9001, the ground pin 9005 and the power pin 9002 are not arranged in contact with each other. As shown in FIG. 9, each of the pins in the unit are separated from each other, in order to prevent from short circuit or signal interference. One with ordinary skill in the art can also understand that the arrangement is done by structural design, which is to isolate each pin in each unit. However, One with ordinary skill in the art can also, by other implementations to achieve the same purpose, e.g., to interest isolation pins or materials.

The pin arranged at the center in the present embodiment and labeled as CP functions an optional pin. By optional, it means that the center pin CP may be removed. In the occasion that the center pin CP is arranged at the center of the adapter 900, the center pin CP can serve as a ground pin, a signal pin or a power pin. The center pin CP can even serve as an alignment pin to structurally locate the connector 901 when the connector 901 is plugged in.

In the present embodiment as shown in FIG. 9, one of the differences from the previous embodiment is that the adapter 900 is arranged with a plurality of power pins 9002. References are made to FIGS. 7 and 9 for further descriptions. Since in the present embodiment the adapter 900 is arranged with a plurality of power pins 9002, each of the plurality of power pins 9002 is connected with the pin 1011 of connector 901 as shown in FIG. 7. That is to say, all of the power signals transmitted from the adapter 900 through the plurality of power pin 9002 are all passed to feedback circuit 9012. The relevant details for the detection circuit 9003, the pin order switching circuit 9008, the interface switching circuit 1009, the control IC 9010 and the memory circuit 9031 can be referred to the previous description, and are thus omitted for the sake of brevity.

Figure 10:
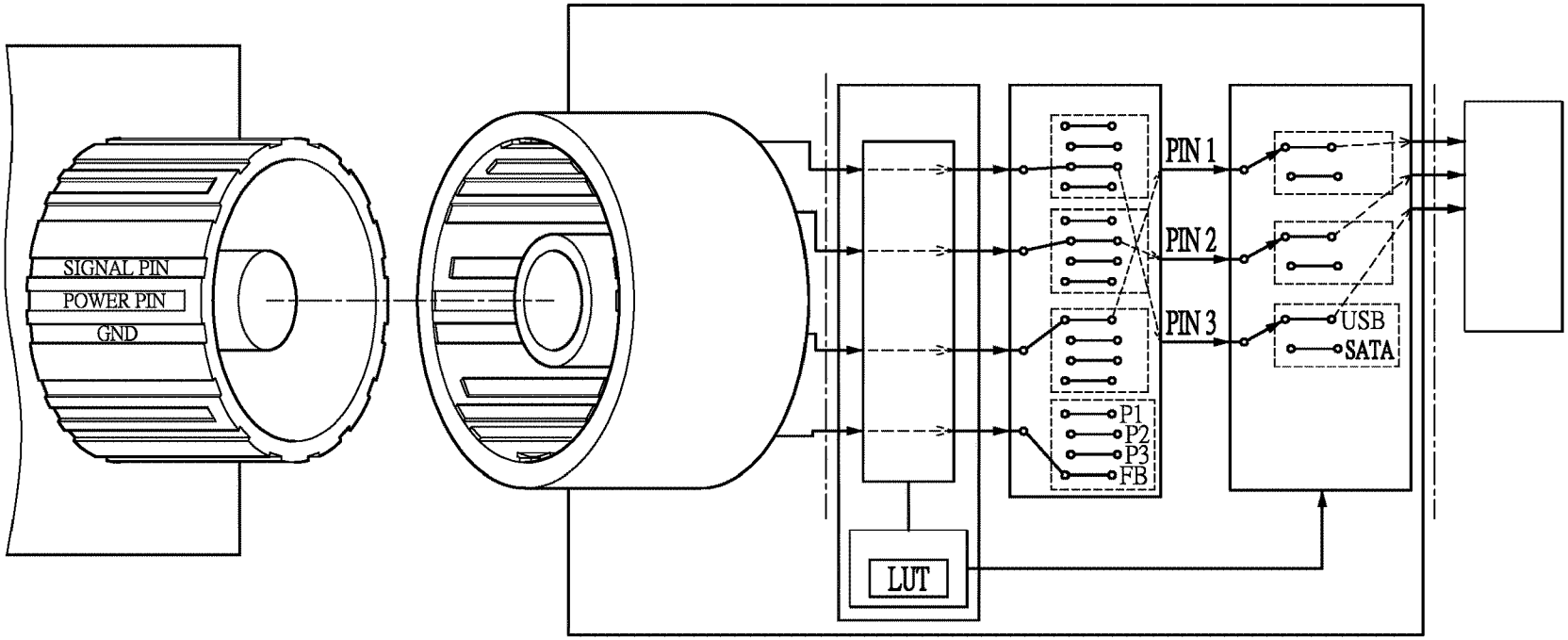
FIG. 10 is a schematic view illustrating the adapter for connecting with a connector according to one of the embodiments of the present disclosure.

Reference is further made to FIG. 10, which is a schematic view illustrating the adapter for connecting with a connector according to one of the embodiments of the present disclosure. In the present embodiment as shown in FIG. 10, the following description would be address without using element numbers for the sake of brevity since the present embodiment is similar to the previous embodiments. The connector is connected with the adapter. In the present embodiment, the plurality of signal pins, the plurality power pins and the plurality of ground pins are arranged on the outer surface of the connector, whereby the adapter is made to correspondingly receive the connector.

One signal pin, one power pin and one ground pin can be viewed as a unit, as mentioned above in the embodiment of FIG. 9. In the present embodiment, the pin arrangement in a signal pin, a power pin and a ground pin. Further in the rest of the units, the pin arrangements are the same.

Figure 11:
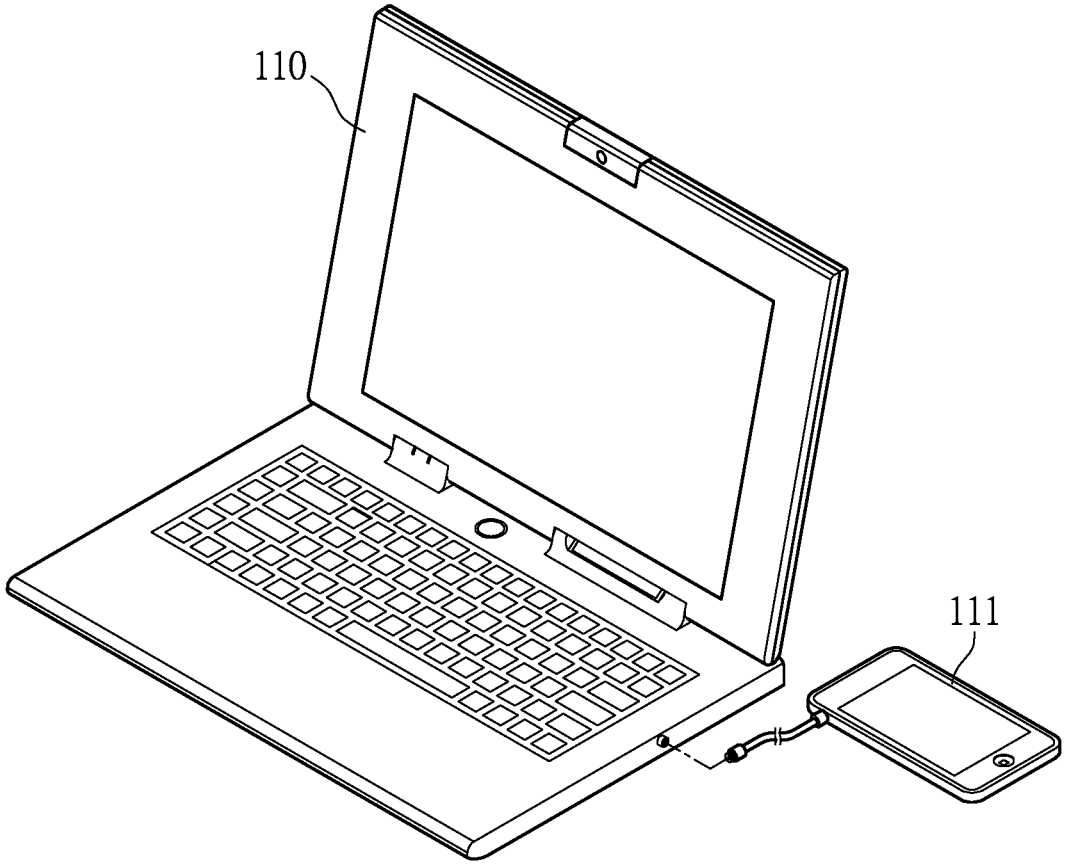
FIG. 11 is schematic view illustrating an electronic device with an adapter for connecting with a connector according to an embodiment of the present disclosure.

Reference is next made to FIG. 11, which is schematic view illustrating an electronic device with an adapter for connecting with a connector according to an embodiment of the present disclosure. As shown in FIG. 11, an electronic device 110 includes an above mentioned adapter. A portable device 11 is connected to the electronic device 110 through an above mentioned connector. In the present embodiment, the electronic device 110 is, but not limited to, a laptop, and the portable device 111 is, but not limited to, a mobile phone.

The adapter and the connector that are addressed above can be utilized in the present embodiment, as long as the adapter and the connector can be correspondingly and/or structurally connected.

The detailed implementations in the present embodiment of FIG. 11 can be referred to as those described in the previous embodiments, such as the detail for identifying the interface, determining the pin order, as well as the arrangements of the kinds of the pins in the present embodiment. Thus the detailed implementations of the present embodiment would be omitted for the sake for brevity.

In sum, an improved adapter for connecting a connector is disclosed in the present disclosure. Moreover, an electronic device with that adapter is also disclosed in the present disclosure. The connector can be inserted into the adapter in multiple directions, with the interface of the connector that can always be identified, and the pin order of the adapter can always be determined.

In addition, one of the aspects of the adapter as provided in the present disclosure can be arbitrarily plugged into with a connection in different directions, which eliminates the one-way plugging in limitation as imposed to Type-A and Type-B connector, which further makes the bi-directional plugging in limitation as in Type-C connector disappeared.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An adapter for connecting to a connector in a first direction, comprising:

a power pin configured to transmit a power signal to the connector;

a plurality of signal pins arranged in a loop, each configured to allow a feedback signal provided by the connector to be transmitted through; and a detection circuit coupled to the power pin and the plurality of signal pins, including a memory circuit storing a look-up table having a plurality of voltage levels corresponding to different types of interfaces, and configured to identify a first interface of the connector according to the voltage level of the feedback signal and the plurality of voltage levels of the look-up table; and define a pin order of the adapter clockwise or counter clockwise from one of the signal pins that receives the feedback signal.

2. The adapter according to claim 1, wherein the pin order of the adapter is re-defined by the detection circuit when the connector is connected to the adapter in a second direction.

3. The adapter according to claim 1, wherein the loop is in a circular shape and the power pin is surrounded by the plurality of signal pins.

4. The adapter according to claim 1, further comprising:

an adapter housing; and a plurality of ground pins;

wherein the plurality of ground pins and the plurality of signal pins are interleavingly-arranged on one of an inner surface and an outer surface of the adapter housing;

wherein the power pin is arranged at a center of the adapter housing.

5. The adapter according to claim 3, wherein an opening is further defined on the adapter housing, and the plurality of signal pins and the plurality of ground pins are closer to the opening than the power pin is.

6. The adapter according to claim 1, further comprising:

a pin order switching circuit coupled to the detection circuit;

wherein the detection circuit controls the pin order switching circuit to switch a first pin connection relationship between the plurality of signal pins and a control circuit for connecting the connector according to the first interface of the connector.

7. The adapter according to claim 6, further comprising:

an interface switching circuit coupled to the pin order switching circuit to switch a second pin connection relationship between the plurality of signal pins and the control circuit;

wherein the detection circuit controls the interface switching circuit for connecting the connector with the adapter according to a second interface of the connector is identified.

8. An adapter for connecting with a connector, comprising:

a plurality of signal pins, each configured to allow a feedback signal provided by the connector to be transmitted through;

a plurality of ground pins;

a plurality of power pins configured to transmit a power signal to the connector; and a detection circuit coupled to the plurality of power pins and the plurality of signal pins, including a memory circuit storing a look-up table having a plurality of voltage levels corresponding to different types of interfaces, and configured to identify a first interface of the connector according to the voltage level of the feedback signal and the plurality of voltage levels of the look-up table; and define a pin order of the adapter clockwise or counter clockwise from one of the signal pins that receives the feedback signal, wherein the plurality of signal pins, the plurality of ground pins and the plurality of power pins are interleavingly-arranged.

9. The adapter according to claim 8, wherein the adapter further comprises a pin order switching circuit coupled to the detection circuit, wherein the detection circuit controls the pin order switching circuit for connecting the connector with the adapter according to the first interface of the connector.

10. The adapter according to claim 9, further comprising:

an interface switching circuit coupled to the pin order switching circuit and the detection circuit;

wherein the detection circuit controls the interface switching circuit for connecting the connector with the adapter according to a second interface of the connector is identified.

11. An electronic device, comprising:

a receptacle adapter configured to receive a corresponding plug connector and having:

a plurality of signal pins arranged in a loop, each configured to allow a feedback signal provided by the connector to be transmitted through; and a power pin configured to transmit a power signal; and a detection circuit coupled to the power pin and the plurality of signal pins, wherein a feedback signal provided by the connector according to the power signal is transmitted to one of the plurality of signal pins in response to the corresponding plug connector being accommodated in the receptacle connector;

wherein including a memory circuit storing a look-up table having a plurality of voltage levels corresponding to different types of interfaces, and configured to identify a first interface of the connector according to the voltage level of the feedback signal and the plurality of voltage levels of the look-up table; and define a pin order of the adapter clockwise or counter clockwise from one of the signal pins that receives the feedback signal.

12. The electronic device according to claim 11, further comprising:

a pin order switching circuit coupled to the detection circuit;

wherein the detection circuit controls the pin order switching circuit to switch a first pin connection relationship between the plurality of signal pins and a control circuit for connecting the connector with the adapter according to the first interface of the connector.

13. The electronic device according to claim 12, further comprising:

an interface switching circuit coupled to the pin order switching circuit and the detection circuit;

wherein the detection circuit controls the interface switching circuit to switch a second pin connection relationship between the plurality of signal pins and the control circuit for connecting the connector with the adapter according to a second interface of the connector is identified.

* * * * *